US009291426B2

(12) United States Patent
Györfi

(10) Patent No.: US 9,291,426 B2
(45) Date of Patent: Mar. 22, 2016

(54) CARRYING DEVICE FOR WEARING A HOLSTER COMPONENT INSIDE THE TROUSER-LEG

(71) Applicant: Tamás Györfi, Debrecen (HU)

(72) Inventor: Tamás Györfi, Debrecen (HU)

( * ) Notice: Subject to any disclaimer, the term of this patent is extended or adjusted under 35 U.S.C. 154(b) by 49 days.

(21) Appl. No.: 13/861,044

(22) Filed: Apr. 11, 2013

(65) Prior Publication Data

US 2014/0014695 A1 Jan. 16, 2014

(51) Int. Cl.
*F41C 33/02* (2006.01)
*F41C 33/04* (2006.01)

(52) U.S. Cl.
CPC ..... *F41C 33/0209* (2013.01); *F41C 33/048* (2013.01)

(58) Field of Classification Search
CPC ..... F41C 33/046; F41C 33/048
USPC ..... 224/222, 587, 661, 911
See application file for complete search history.

(56) References Cited

U.S. PATENT DOCUMENTS 5,215,238 A * 6/1993 Baruch ..... 224/243
5,294,031 A * 3/1994 Volpei et al. ..... 224/682
6,149,042 A * 11/2000 Rassias ..... 224/661
7,681,255 B2 * 3/2010 Morales et al. ..... 2/247
2003/0205595 A1 * 11/2003 Young ..... 224/230
2008/0061098 A1 * 3/2008 Hoffner ..... 224/661
2012/0117713 A1 * 5/2012 Hoffner ..... 2/227
2012/0131734 A1 * 5/2012 Sindicich ..... 2/458
2013/0212791 A1 * 8/2013 Hocking et al. ..... 2/464
2013/0269086 A1 * 10/2013 French ..... 2/250
2014/0090140 A1 * 4/2014 Craig et al. ..... 2/2.5

* cited by examiner

*Primary Examiner* — Brian D Nash

(74) *Attorney, Agent, or Firm* — Jason D. Voight

(57) ABSTRACT

A carrying device for wearing a holster component, preferably for the concealed placement of law-enforcement equipment placed in a holster component inside the trouser-leg, wherein a slit opening is formed in the trousers to provide access to the equipment, such a way that inside the trouser-leg (3), positioned in a way to be accessible through the slit opening (4), there is a carrying component (5) suitable for wearing the holster component (2), which is fastened to the trousers' waistband (6), at a given distance from it, by holding components (7), furthermore the carrying component (5) is equipped with thigh-fasteners (8), and there are joining components (9) placed on the holster component (2) and on the carrying component (5) for the purpose of joining together the holster component (2) and the carrying component (5).

15 Claims, 4 Drawing Sheets

CARRYING DEVICE FOR WEARING A HOLSTER COMPONENT INSIDE THE TROUSER-LEG

A carrying device for wearing a holster component, preferably for the concealed placement of law-enforcement equipment placed in a holster component inside the trouser-leg, where a slit opening is formed in the trousers to provide access to the equipment.

The invention primarily facilitates the concealed wearing of guns and service equipment (cuffs, gas spray, etc.) for persons working in the field of law-enforcement, in such a way that the load arising from the weight of the equipment to be concealed is not exerted directly on the outer surface of the trousers.

Law-enforcement equipment is usually worn in thigh-modules placed on an unconcealed surface. This solution is used by several manufacturers in the form of components that are separate from the trousers, can be worn on the thigh outside the trousers, or can be attached to the belt. Their concealed wearing is not possible.

Another method for wearing the above mentioned equipment is the fastenable side-pocket. For instance, the solution used by TMH Trading GmbH (Ennser Strasse 39 AT-4407 Steyr-Gleink Austria http://www.clawgear.eu/) makes it possible to fasten the trousers' side-pocket to the thigh (http://www.clawgear.eu/b/en/MOLLE/33/). The regular side-pocket of the trousers is fastened, so the load arising from the weight of the equipment to be concealed is borne by the outer fabric of the trousers. The fastening is visible to any observer, and thus concealed wearing is only partially effected. Side-pockets are not suitable for firmly fastening holsters.

In the case of normal civilian clothes, persons working in the field of law-enforcement have limited opportunities for the concealed wearing of their service equipment. The general solution is to use pouches attached to the belt, and to place the equipment in them. Carrying the equipment without attracting attention is solved by wearing the T-shirt or shirt outside the trousers during summertime, or by putting on a vest, however, with this solution, the silhouette of the equipment is often visible, thus, in the event of "undercover" work, this way of wearing the equipment can even cause the failure of an action.

During colder weather the equipment can be concealed under the coat, or in the case of special coats it can be carried in the coat. In this case the coats do not distribute the load arising from the weight of the equipment. This can hinder movement, and can change the symmetrical wearing of the coat or jacket.

Another popular solution is the use of shoulder or belt bags developed for this purpose, however, a practiced eye can recognize the function of these bags, and again the "undercover" action can fail. All of the mentioned solutions more or less hinder the taking out of the equipment, most of all the gun quickly, and that can endanger human lives in certain situations.

The carrying device according to our patent application allows the quick and professional use of the equipment—in civilian looking clothes, without external signs, properly fastened and without hindering movement.

Our aim was to develop a carrying device that is suitable for the concealed placement of law-enforcement equipment, placed in a holster component, inside the trouser-leg in such a way that the load arising from the weight of the equipment to be concealed is not exerted directly on the outer surface, fabric of the trousers, and thus during movement the normal "hang" of the trousers' fabric is not affected by the given equipment. The user shall be able to use the trousers' regular pockets independently of the carrying device, without interfering with its function. The carrying device shall be an integral part of the trousers. The carrying device shall be fastened to the thigh with one or more adjustable, flexible straps in a such way that during movement it shall hold the equipment to be concealed firmly, and it shall not hinder movement. The surface of the carrying device shall be suitable for attaching any holster component, MOLLE or STRIKE panel. Right-handed or left-handed users shall be able to use it equally. The slit opening formed in the trouser-leg shall make it possible to take out the equipment quickly and easily.

We recognized that if the carrying device is fastened inside the trousers to the waistband, and to the thigh by flexible straps, and a slit opening is formed in the trouser-leg at the height of the carrying component of the carrying device, then our aim can be achieved. Wearing comfort can be enhanced if we apply inner pants underneath the trousers, extending at least to the bottom of the carrying component, sewn to the waistband of the trousers. In that case, the holding components defining the height of the carrying component can be fastened in full length to the inner pants. The legs of the inner pants can be attached to the respective legs of the trousers.

Thus the present patent application relates to a carrying device for wearing a holster component, preferably for the concealed placement of law-enforcement equipment placed in a holster component inside the trouser-leg. A slit opening is formed in the trouser-leg to provide access to the equipment. Inside the trousers, positioned in a way to be accessible through the slit opening, there is a carrying component suitable for wearing the holster component, which is fastened to the waistband of the trousers, at a given distance from it, by holding components. The carrying component is equipped with thigh-fasteners, and there are joining components placed on the holster component and on the carrying component for the purpose of joining together the holster component and the carrying component.

Preferably, the joining component is a hook and loop fastener, buckle, snap fastener or any other known fastener. Preferably, there are inner pants inside the trousers, fastened to the trousers' waistband, to which the holding components of the carrying component fastened to the trousers' waistband with holding components are also fastened, and the ends of the inner pants' legs are attached to the respective trouser-legs, if necessary.

Preferably, the holding components consist of inflexible strap(s), and the thigh-fasteners consists of adjustable strap(s) with flexible parts, joined together by a hook and loop fastener, loop, or buckle. Preferably, the slit opening is formed transversally and/or longitudinally to the trouser-leg, and is closed by a closing component, for example a zip or a hook and loop fastener, and pocket(s) is(are) placed on the outer surface of the trouser-leg, at least at the height of the carrying component.

The present invention is presented in detail through the figures.

Figure 1:
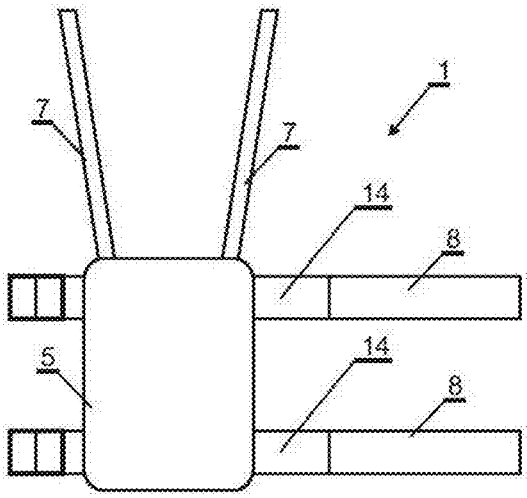
FIG. 1 is a front-view of the carrying device.
Figure 2:
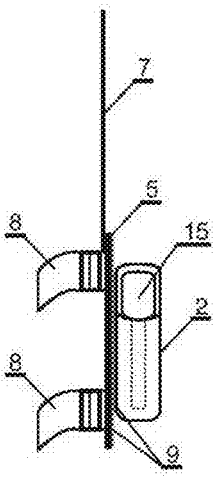
FIG. 2 is a side-view of the carrying device with supplementary accessories, namely the joining components, the holster component, and the equipment placed in the holster component.
Figure 3:
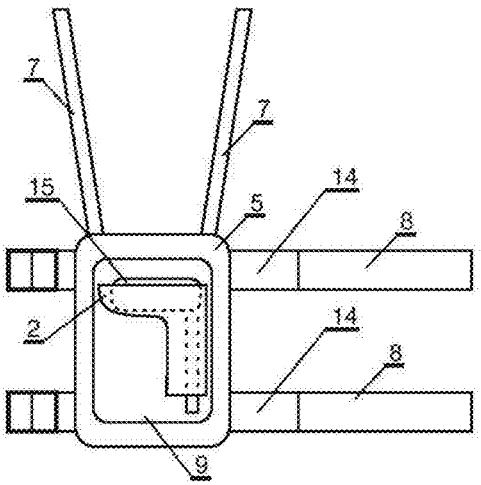
FIG. 3 is a front-view of the carrying device with supplementary accessories, namely the joining components, the holster component, and the equipment placed in the holster component.
Figure 4:
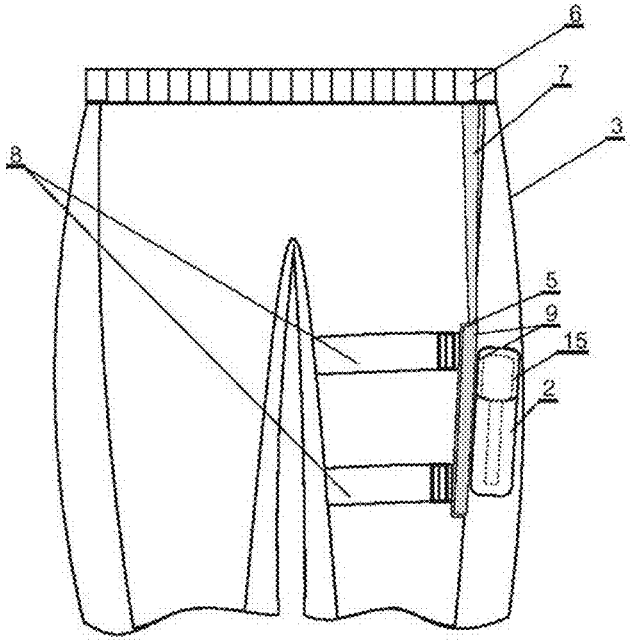
FIG. 4 is a front-view x-ray drawing of the carrying device (with accessories) worn without inner pants under the trousers.
Figure 5:
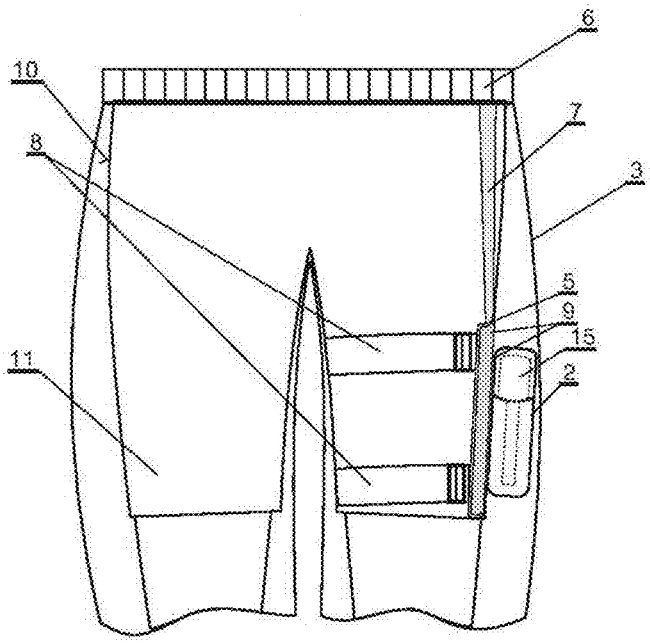
FIG. 5 is a front-view x-ray drawing of the carrying device (with accessories) worn with inner pants under the trousers, where the legs of the inner pants are not attached to the trouser-legs.
Figure 6:
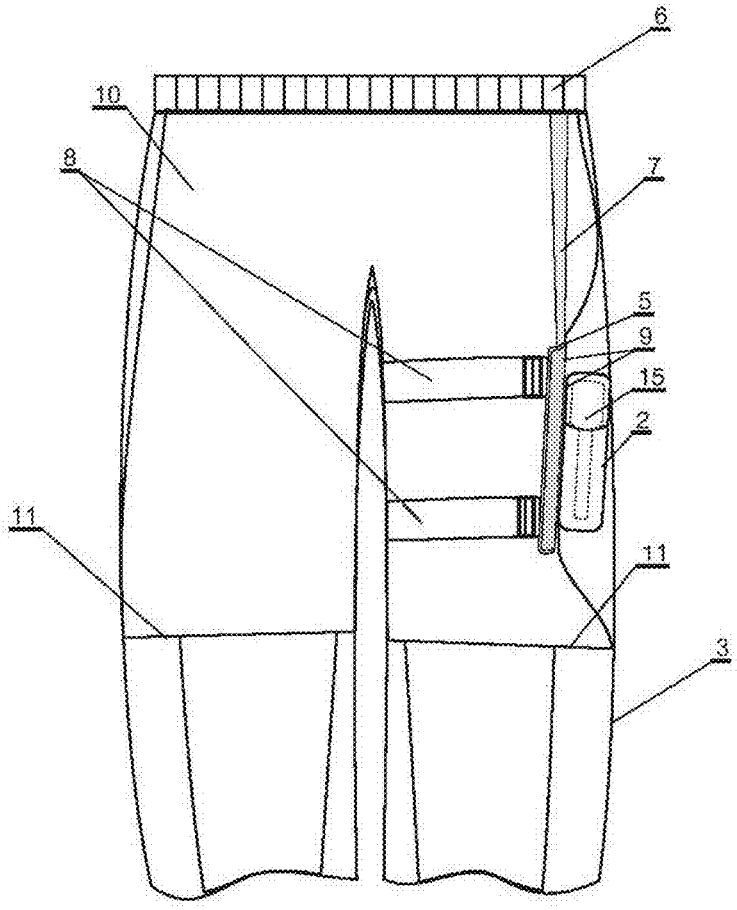
FIG. 6 is a front-view x-ray drawing of the carrying device (with accessories) worn with inner pants under the trousers, where the legs of the inner pants are attached to the trouser-legs.
Figure 7:
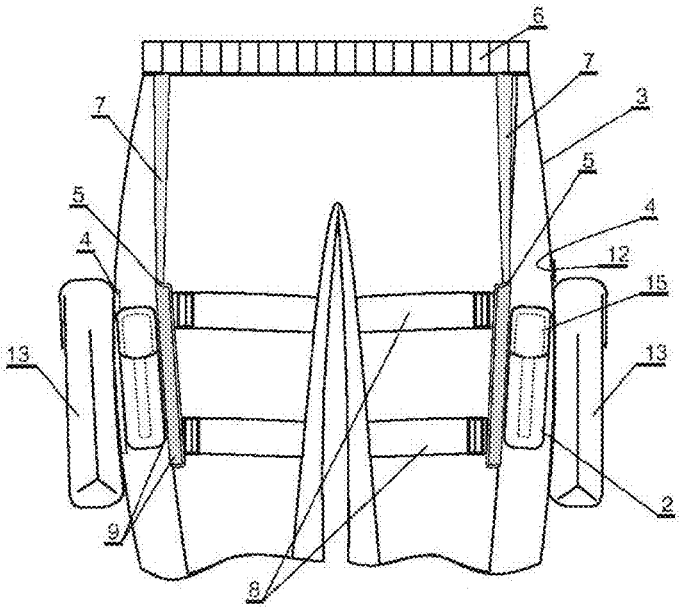
FIG. 7 is a front-view x-ray drawing of the carrying device (with accessories) worn on both thighs without inner pants under the trousers.
Figure 8:
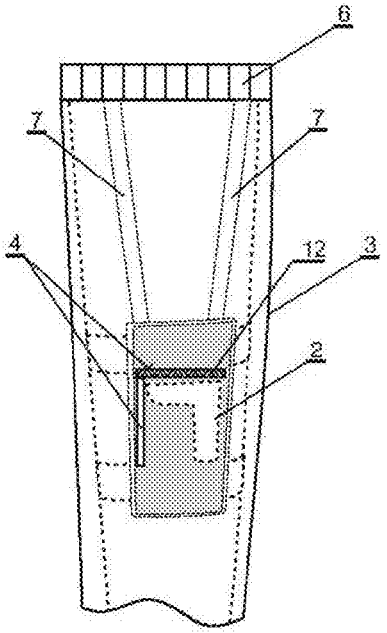
FIG. 8 is a side-view x-ray drawing of the carrying device (with accessories) worn without inner pants under the trousers.

The carrying device 1 (FIG. 1) according to our invention was developed for wearing a holster component 2. Essentially, for the concealed placement of law-enforcement equipment 15 placed in the holster component 2 inside the trouser-leg 3 (FIGS. 2 and 3). Naturally, the carrying device 1 according to the patent application can also be worn under motorcycle clothing/trousers. In that case, the equipment 15 is for example a thigh-bag, in which documents and other necessary objects can be stored. A slit opening 4 is formed in the trouser-leg 3 to provide access to the equipment 15. The slit opening 4 is preferably formed at the upper or side edge of the pocket 13, and is closed by a closing component 12 (FIGS. 7 and 8). The closing component 12 can be a zip or a hook and loop fastener, or any known solution. Inside the trouser-leg 3, positioned in a way to be accessible through the slit opening 4, there is a carrying component 5 suitable for wearing the holster component 2, which is fastened to the waistband 6 of the trousers, at a given distance from it, by holding components 7. The carrying component 5 is equipped with thigh-fasteners 8 that allow the fastening of the carrying component 5 to the thigh (FIG. 4). For the purpose of joining together the holster component 2 and the carrying component 5, there are joining components 9 placed on the holster component 2 and on the carrying component 5, which can be a hook and loop fastener, a buckle, a snap fastener, or any other known fastener (FIG. 2). The wearing comfort of the trousers can be enhanced if we apply inner pants 10 inside the trousers (FIG. 5). They can be fastened to the waistband 6 of the trousers. The holding components 7 of the carrying component 5 can be fastened not only to the waistband 6 of the trousers, but in full length to the inner pants 10 as well, if necessary. Both the inner pants 10 and the holding components 7 are made of inflexible material that keeps its size, so this can be done easily. The wearing comfort of the trousers and the carrying device 1 can be further enhanced if the ends of the inner pants' 10-legs 11 are attached to the respective trouser-legs 3 (FIG. 6).

For the sake of general applicability, the thigh-fasteners consist of adjustable strap(s) with flexible parts 14, joined together by a hook and loop fastener, loop, or buckle. Naturally, the thigh-fasteners 8 can be made of an inflexible strap of adjustable length as well, the respective ends of which can be joined by a buckle.

The slit opening 4 is formed transversally (FIG. 7), or transversally and longitudinally to the trouser-leg 3 (FIG. 8), and is closed by a closing component, for example a zip or a hook and loop fastener, and pocket(s) 13 is(are) placed on the outer surface of the trouser-leg, at least at the height of the carrying component 5 (FIG. 7).

The design of the outer part of the trousers is based on regular trousers. A significant difference is the slit opening 4 formed in the trouser-leg 3, which provides unhindered access to the equipment 15 placed in the holster component 2 attached to the carrying device 1. The design and closing of the slit opening 4 depends on the style of the trousers and also on the current fashion.

It is possible to form the slit opening 4 only horizontally in the trouser-leg 3, but it can also be an external trouser component that can be opened in 360°, covered by the pocket 13 placed on the outer surface. An important part of the trousers' design is that it shall be loose enough to provide sufficient space for the equipment 15 concealed under it.

The carrying device 1 can consist of for example an elastic carrying component 5 equipped with a hook or loop surface, to which one or more flexible thigh-fasteners 8 are attached in the way presented in the figures, by which, when the carrying device 1 is used, the carrying component 5 can be fastened to the thigh with appropriate flexibility with the help of tightness adjusting components. After the fastening, the holster component 2 can be firmly attached to the carrying component 5 of the carrying device 1 by means of for example a hook or loop surface fastened on its side towards the carrying component 5 by gluing or sewing, and the equipment 15 can be placed in the holster component 2. The carrying device 1 and the equipment placed in the holster component attached to it exert the load arising from their weight on the thigh. When the carrying device 1 is not used, the tightening of the thigh-fasteners 8 is not necessary, so in that case the wearing of the carrying device 1 is almost unnoticeable. The holding components 7 attached to the upper part of the carrying device 1 help to keep the module in place, and to transfer the load left by the thigh-fasteners 8 to the waistband 6.

The fabric of the inner pants 10 is comfortable, air-permeable textile. Its tasks are to keep the carrying device 1 in the right position, and to ensure the unhindered taking on/off of the trousers. Its length is preferably from the waistband to the lower end of the thigh. The fastening of the carrying device 1 to the inner pants 10 can be easily solved by sewing. The carrying component 5 and the holding components 7 require firm fixing. The thigh-fasteners 8 can move on the inner pants 10.

As the trousers and the inner pants 10 are fixed together (FIG. 6) at the waistband and the lower end of the thigh, care should be taken to ensure that after the inner pants 10 and the trousers have been stitched together, with tightened thigh-fasteners there is enough material left allowing the outer trousers and the inner pants to move independently during movement.

The advantage of our patent application is that the user can use the trousers' regular pockets independently of the thigh-module, without interfering with its function. The thigh-module forms an integral part of the trousers. The thigh-module is fastened to the thigh with adjustable, flexible strap(s), therefore during movement it holds the equipment to be concealed firmly, and it does not hinder movement. The joining component, for instance a hook or loop surface, of the thigh-module is suitable for attaching any carrying pouch, MOLLE or STRIKE holster component. Right-handed and left-handed users can use it equally. The load arising from the weight of the equipment to be concealed is not exerted directly on the trouser-leg, and thus during movement the normal "hang" of the trouser-leg is not affected. The thigh-module's slit opening formed in the outer surface of the trouser-leg makes it possible to take out the equipment in any position.

LIST OF ITEMS

1 carrying device
2 holster component

3 trouser-leg
4 slit opening
5 carrying component
6 waistband
7 holding component
8 thigh-fastener
9 joining component
10 inner pants
11 leg
12 closing component
13 pocket
14 flexible part
15 equipment

The invention claimed is:

1. A carrying device for concealed placement of law-enforcement equipment placed in a holster component inside a trouser-leg said carrying device comprising trousers having a slit opening (4) formed therein to provide access to the equipment, inner pants (10) inside the trousers, fixed to the trousers at a waistband (6) thereof, a carrying component (5) positioned inside the trousers in a way to be accessible through the slit opening (4), fixed to the inner pants (10), and suitable for wearing the holster component (2), holding components (7) integrally fastening the carrying component (5) inside the trousers at the waistband thereof, at a given distance from it, and fixed in full length to the inner pants (10), thigh-fasteners (8) for fastening the carrying component (5) to a thigh of a user, a joining component (9) placed on the holster component (2) and on the carrying component (5) for joining together the holster component (2) and the carrying component (5).

2. The carrying device according to claim 1, wherein the joining component (9) is a hook and loop fastener, buckle, snap fastener or any other known fastener.

3. The carrying device according to claim 1, wherein ends of legs (11) of the inner pants' (10) are attached to respective trouser-legs (3) of the trousers.

4. The carrying device according to claim 3, wherein the ends of the inner pants are further fixed inside the trousers at a lower end of a thigh thereof.

5. The carrying device according to claim 3, wherein the legs (11) of the inner pants' (10) are attached to the respective trouser-legs (3) at a connection point where the inner pants' (10) legs (11) and the trouser-legs (3) have the same diameter, and wherein the diameter of the inner pants' (10) legs (11) is tapered from the connection point in the direction of the carrying component (5).

6. The carrying device according to claim 1, wherein the holding components (7) consist of inflexible strap(s) so as to transfer any load left by the thigh-fasteners (8) to the waistband (6).

7. The carrying device according to claim 1, wherein the thigh-fasteners (8) consist of adjustable strap(s) with flexible parts (14), joined together by a hook and loop fastener, loop, or buckle.

8. The carrying device according to claim 1, wherein the slit opening (4) is formed transversally and/or longitudinally to a trouser-leg (3).

9. The carrying device according to claim 1, wherein the slit opening (4) is closed by a closing component (12).

10. The carrying device according to claim 9, wherein the closing component (12) is a zip or a hook and loop fastener.

11. The carrying device according to claim 1, further comprising at least one pocket (13) placed on an outer surface of the trouser-leg (3) of the trousers, at least at the height of the carrying component (5).

12. The carrying device according to claim 1, wherein the inner pants are made of air-permeable textile.

13. The carrying device according to claim 1, wherein the inner pants extend at least to the bottom of the carrying component and wherein the inner pants are situated between the carrying component and a user.

14. The carrying device according to claim 1, wherein the inner pants (10) are fastened to the trousers' waistband (6) by sewing.

15. The carrying device according to claim 1, wherein the inner pants (10) are made of an inflexible material.

* * * * *